US008490808B1

(12) United States Patent
Snyder

(10) Patent No.: US 8,490,808 B1
(45) Date of Patent: Jul. 23, 2013

(54) CLAMSHELL CONTAINER HOLD OPEN MECHANISM

(76) Inventor: Robert George Snyder, Woodstock, GA (US)

( * ) Notice: Subject to any disclaimer, the term of this patent is extended or adjusted under 35 U.S.C. 154(b) by 257 days.

(21) Appl. No.: 12/803,147

(22) Filed: Jun. 21, 2010

Related U.S. Application Data

(60) Provisional application No. 61/275,752, filed on Sep. 3, 2009.

(51) Int. Cl.
*B65D 6/28* (2006.01)

(52) U.S. Cl.
USPC ..... 220/4.22; 220/4.23; 229/114; 229/145

(58) Field of Classification Search
USPC ..... 206/45.25, 45.26, 45.27, 45.21, 45.22, 206/45.23; 220/831, 832, 4.22, 4.23; 229/125, 229/130, 131, 145, 146, 153, 114
See application file for complete search history.

(56) References Cited

U.S. PATENT DOCUMENTS

| | | | | | |
|---|---|---|---|---|---|
| 1,090,559 | A * | 3/1914 | Morrison | 229/145 |
| 1,125,987 | A * | 1/1915 | Eichhorn | 206/45.21 |
| 1,411,678 | A * | 4/1922 | Walker | 229/125 |
| 1,592,374 | A * | 7/1926 | Lytle | 229/122.32 |
| 1,718,872 | A * | 6/1929 | Ortiz | 229/125 |
| 2,410,486 | A * | 11/1946 | Evans | 229/120.25 |
| 2,839,236 | A * | 6/1958 | Dunning | 229/145 |
| 3,038,463 | A * | 6/1962 | Daymon | 126/682 |
| 3,545,665 | A * | 12/1970 | Nimaroff | 229/145 |
| 4,877,178 | A * | 10/1989 | Eisman | 229/114 |
| 5,205,476 | A * | 4/1993 | Sorenson | 229/114 |
| 5,553,772 | A * | 9/1996 | Jensen | 229/148 |
| 7,743,970 | B2 * | 6/2010 | Bates et al. | 229/117.16 |

* cited by examiner

*Primary Examiner* — David Fidei
(74) *Attorney, Agent, or Firm* — Rodgers & Rodgers

(57) ABSTRACT

An open clamshell-type food container is prevented from collapsing by means of a securing tab joined to the side wall of one of the container shells, a side wall joined to the other container shell, the two side walls being in alignment, and the securing tab being affixed to the other side wall.

5 Claims, 6 Drawing Sheets

CLAMSHELL CONTAINER HOLD OPEN MECHANISM

The benefits under 35 USC 119 are claimed of provisional patent application 61/275,752 filed Sep. 3, 2009.

BACKGROUND OF THE INVENTION

This invention relates to containers commonly used for food service, but could also be used to hold toys, repair parts, assembly parts and other small items. More specifically, this invention relates to the use of such containers and a means to hold them in a substantially full open condition, such as, but not limited to fast food clamshell containers used in carryout or drive-thru restaurants. Even more specifically, this invention creates a strong open tray from an otherwise hinged two-shell container which will structurally span between a seated user's upper thighs.

Clamshell containers are commonly used for serving food, such as fast-food hamburgers or chicken meals. The containers currently offered have various securing devices to keep them closed for serving and transporting the food. However, when they are opened for eating the food, provisions for keeping the containers open and not collapsing are necessary. When the material used for the container blank has an elastic memory, a problem occurs when the assembled open container tends to return to the previous closed position. Another common problem occurs when the open container is rested on a person's lap—which is often done by occupants of an automobile or truck after purchasing food through a drive-thru window. When the container is rested with one shell on one thigh and the other shell on the other thigh, the flexible container hinge, which connects the two shells, has a tendency to allow the two shells to rotate together causing the container to fall between the diner's legs when subjected to gravitational or other substantially vertical force; thus causing unintended full or partial closure of the container. This situation is particularly troublesome for young children—such as when two different foods are served on the opposite shells of the open container in a divided serving tray manner.

Clamshell containers are widely used to serve and transport fast food, carry out meals, box lunches, and leftover portions of meals. Similar containers can also be used to contain toys, puzzle parts, repair parts, assembly parts, craft parts, and so on. At times the users will desire to access the contents of the container when the user is in a seated position, such as but not limited to sitting in the seat of a vehicle. In some occasions, it is desired for the two container shells to be supported by the user's upper thighs. In those occasions, it is often desirable for the two container shells to remain in an open position, and resistant to the tendency of closure of the container, particularly when subjected to substantially perpendicular gravitational or user induced forces. It is common to use containers with two container shells which are foldably interconnected, commonly known as clamshell containers. There are various existing designs of clamshell containers which incorporate features to secure the container in a closed position. U.S. Pat. No. 4,232,816 to Johnson et al and U.S. Pat. No. 6,283,364 to Gray Sr. describe examples of clamshell containers that incorporate a means for securing the containers in the closed position. However, most existing containers suffer from a lack of means to secure them in an open position.

U.S. Pat. No. 5,538,179 to Cai provides a means to secure the shells in the open position, but suffers from an inherently weak securing design, which is dependant on the flexural strength of the inner walls of the shells. Further, this design suffers from an inherently weakened and severed hinge which connects the two shells, thus reducing the structural strength necessary to span the lateral direction of the open container shells. Finally, this design is limited in that it is dependant on a container shell geometry which provides for direct contact between the two inner walls of the open container shells, thus precluding this design to be applicable to sloped inner wall shell designs which do not contact each other when the container is opened to approximately one hundred and eighty degrees from the closed condition.

U.S. Pat. No. 5,826,784 to Wojcik overcomes the deficiencies described herein for Cai's design. However, this design suffers from the requirement to incorporate additional secondary material over what is required for the fabrication of the container itself, absent the securing device. This requires additional material and labor expense, complexity in manufacturing, and increases the amount of the resulting waste when the container is ultimately discarded. Further, this design suffers from requiring the user to blindly or awkwardly manipulate the tape latching device to the bottom of the open container shell, which may be challenging for certain users, such as young children or elderly adults.

BRIEF SUMMARY OF THE INVENTION

When open clamshell containers are supported by the upper thighs of a seated user, it is often desirable for the secured open container to function as a beam subjected to substantially perpendicular and lateral gravitational or user induced forces. It is also often desirable to maintain a clamshell container in nearly full open condition despite the elastic memory of the container material which may tend to partially close the container. Such a device can be fabricated from a container blank itself within the confines of a rectangular shape bounded by the container if it did not have the securing device.

A user-operated securing device is created during the initial die cutting and fabrication of the container blank, whether fabricated from paperboard, foam board or other materials commonly used for folded clamshell containers. When assembled and operated in the secured and open condition, this present invention utilizes resisting structural force comprised of compressive and tensile elements, rather than relying on flexural elements which are relatively weaker in structural properties for the materials commonly used for the fabrication of clamshell containers. The securing device is die-cut with a variety of shapes. The hinge connecting the two container shells is not weakened in the present invention. Tapered inner wall container shell configurations are accommodated by the present invention, without requiring them to be in physical contact with each other when the container is in the substantially full open condition. Finally, the present invention does not require any secondary, additional material, other than the material blank of the same size as otherwise required. Rather, when the container is fabricated from sheet material blanks, such as paperboard commonly used in the industry, it uses material for the securing device which would otherwise be discarded as manufacturing waste. In the preferred embodiment, the latching device is located on, and structurally connects the sidewalls of the two shells. Such location is conveniently located in clear view of the user, and is easy to manipulate and engage by users of this present invention.

The preferred design incorporates a securing device which is an extension of the fabricated material blank. When the container is assembled by folding and gluing, the securing device is folded against the wall of one of the shells. It may be secured temporarily to the shell wall so it is out of the way until desired to be used by the user. When it is desired to secure the container in an open condition, the securing device is unfolded by the user, the container then opened by rotating the shells to approximately one hundred eighty degrees, and finally the securing device is pressed against the side wall of the opposite shell. Various means of attaching the securing device to the opposite shell may be used, such as adhesive, glue, magnets, hook and loop or other fasteners. A removable release-type liner tape may be used for covering and protecting the adhesive prior to exposing it and use by the user. Such liner tape may also be secured to the end wall, where it remains when the securing device is unfolded and thus exposes the adhesive. The securing device acts in tension to prevent closure of the container either from elastic memory of the blank material, or from substantially vertical forces applied to the shell or shells when the open container functions as a simple supported beam condition. The securing device acts in compression to prevent further opening beyond approximately one hundred eighty degrees when the open container functions as an overhung beam condition.

An alternate embodiment uses a securing device which interlocks or engages with an opening in the wall of the opposite shell. This may be a hooked securing device which engages into a slotted opening in the opposite shell. In this embodiment, the securing device may have been temporarily folded out of the way against the wall of the shell, as described in the preferred embodiment. A variety of designs may be used for the securing device and receiver opening, such as a hook or tee tab and slot, a hook or tee tab and crescent, or other designs.

A second alternative embodiment design for the latching device is engaged by the user from the top side of the open container shells, and incorporates a strong latching design which substantially connects the base panels of the two shells to create a tension member for the structure spanning in a simple supported beam condition. The securing device is pushed through and engages a receiver opening in the end wall of the opposite shell. A truncated oval tab and star-shaped receiver is shown in this design, however other shapes may be used for the tab and receiver. The oval tab is pushed out of alignment with the inner wall of one shell and through the star-shaped receiver in the inner wall of the other shell by using a finger tip, pencil, eating utensil, drinking straw or other suitable object. For clamshell containers with sloped shell end walls, a longer securing device that incorporates an extended neck can be used to span the distance between sloped end walls to facilitate a desired container open condition of approximately one hundred-eighty degree when the end walls are not in contact or close proximity with one another. One of the key features in this second alternative embodiment design is that securing plane is created near the location of maximum possible distance from the container hinge. This maximizes the moment arm length of the force couple to maximize the moment resisting force which can be developed by the securing device—thus, minimizing tensile and compression forces to avoid failure of the securing device and the container structure surrounding the receiver opening. Another important aspect of this design is that the securing arrangement creates a structural connection close to, or directly between, the planes of the base panel surfaces of the two shells. This eliminates reliance on the flexural strength of the end walls to maintain the open or secured condition. Although the securing device can be easily reversed for subsequent transport and storage of the food, the container may be discarded in the open condition.

A third alternative embodiment design for the latching device incorporates an integral strap to secure the shells from rotating and partial closure. Although this design requires additional material outside the border of the material blank otherwise required, it is useful for containers fabricated from materials which do not use flat stock blanks, such as thermoformed polystyrene plastic food trays.

DETAILED DESCRIPTION OF THE INVENTION

The clamshell container of the preferred embodiment is constructed from a thin sheet of material, such as paperboard or polystyrene foam, and is cut and formed into the desired shape by a variety of processes, such as die-cutting/stamping. The clamshell container is assembled by folding flaps and walls along the folding score line, and adhering adjoining components together. The interconnection are most often joined with adhesive but may also be joined by other methods, such as taping or stitching.

Figure 1:
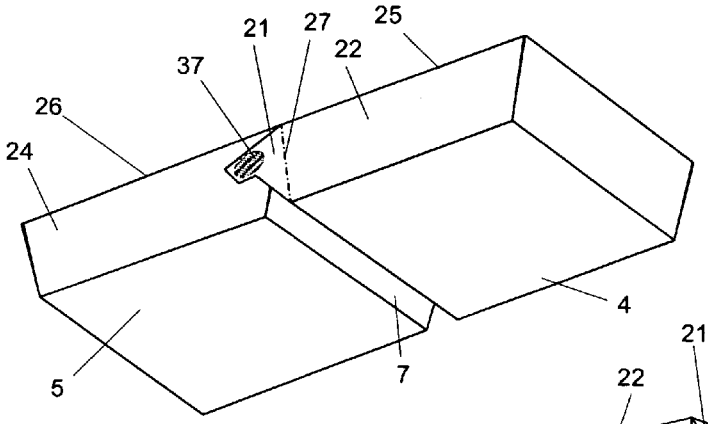
FIG. 1 is a bottom perspective view of the present invention in the open and secured condition, illustrating the components that make up the preferred embodiments.

In FIG. 1, shell 25 is hingedly attached to shell 26. Securing tab 21 is hingedly attached to side wall 22 at fold line 27. Adhesive 37, shown by means of stippling, or other suitable securing method is used by the user to selectively attach securing tab 21 to side wall 24 of the opposite shell. This creates a structural beam element which is capable of resisting closure of the container by rotating the shells towards each other.

Figure 2:
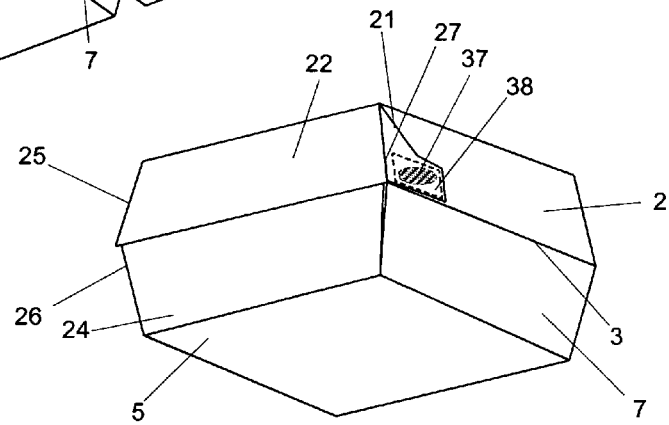
FIG. 2 is a bottom perspective view of the present invention in the closed condition, showing the securing device of the preferred embodiment in a collapsed or folded condition.

In FIG. 2, securing tab 21 is shown folded against inner wall 2. It may be temporarily secured out of the way of the user with a releasable adhesive or other method of temporary attachment. Shell 26 is hingedly attached to shell 25 by hinge 3. Adhesive 37 is adhered to back side of securing tab 21. Adhesive 37 and liner 38 are positioned behind securing tab 21 and in front of inner wall 2.

Figure 3:
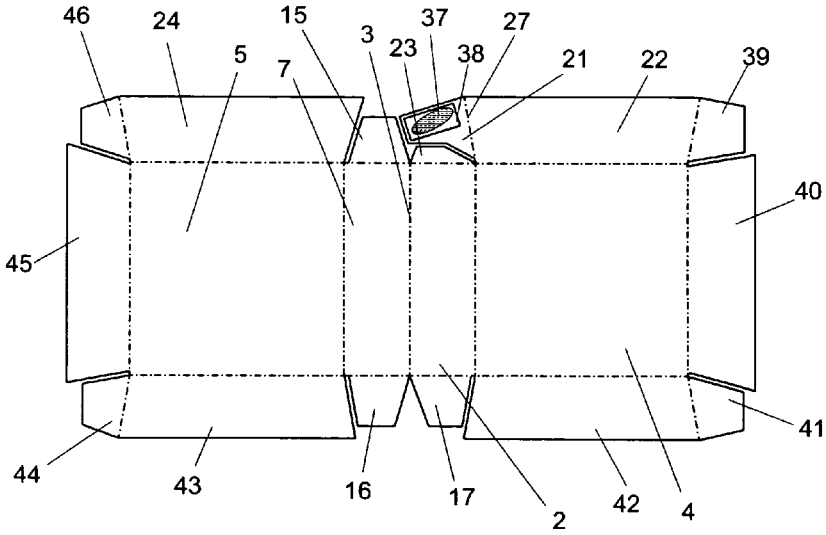
FIG. 3 is a plan view of the unfolded and unassembled blank showing the inside surface for the preferred embodiment.

In FIG. 3, securing tab 21 is hingedly attached to side wall 22 at fold line 27. Flap 23 is shown with a shorter projection than flap 15, flap 16 or flap 17 to create a wide securing tab 21. However, flap 15, flap 16 and flap 17 may be of identical, longer or different projections from flap 23. One of the features of this design is that the securing tab 21 is created within the confines of the rectangular dimensions bounded in part by the edges of side wall 22 and side wall 24. Adhesive 37 is shown in hidden lines behind liner 38, and is adhered to securing tab 21. To assemble the fabricated blank shown in FIG. 3 into the assembled two-shell clamshell container shown in FIG. 1, the following components are joined: flap 15 to side wall 24; flap 46 to outer wall 45; flap 44 to outer wall 45; flap 16 to side wall 43; flap 17 to side wall 42; flap 41 to outer wall 40; flap 39 to outer wall 40; and flap 23 to side wall 22.

Figure 4:
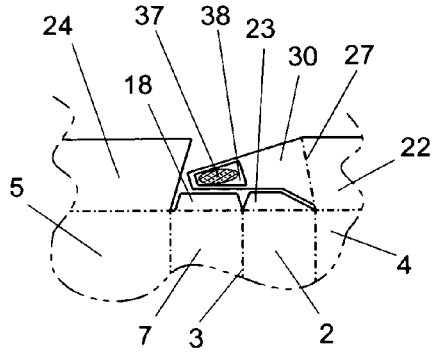
FIG. 4 is a partial detail plan view of an extended tab version of the preferred embodiment viewed from what will be the inside of an assembled container.

In FIG. 4, an extended tab version of the preferred embodiment shows the container blank prior to folding and assembly, where a longer securing tab 30 is used in lieu of securing tab 21 as shown in FIG. 3. Flap 18 has a shorter projection to allow for the longer securing tab 30 to be cut from the material blank. Adhesive 37 is underneath liner 38, and is adhered to securing tab 30.

Figure 5:
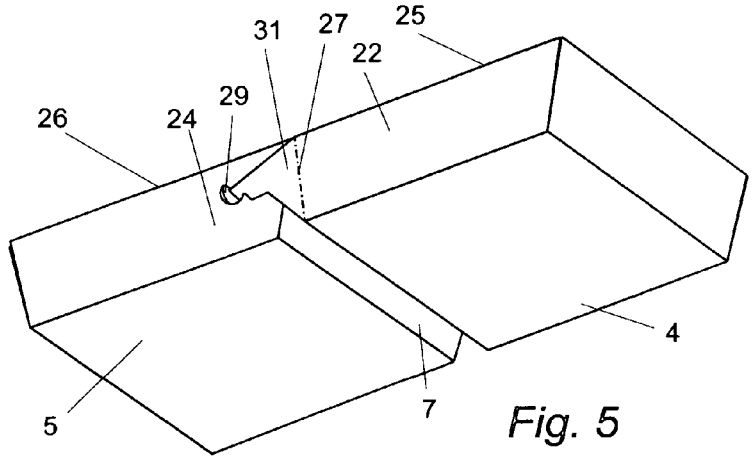
FIG. 5 is a bottom perspective view of the present invention in the open and secured condition illustrating the components of an alternative embodiment.

In FIG. 5, securing tab 31 is hingedly attached to side wall 22 at fold line 27. The hook shaped design of securing tab 31 has been inserted and engaged by the user into receiver aperture 29. When the open container is supported by a table or when supported by supports in a simple supported condition, and is subjected to substantially vertical forces, this creates a beam element which is capable of resisting closure of the container by rotating shells 25 and 26 towards each other.

Figure 6:
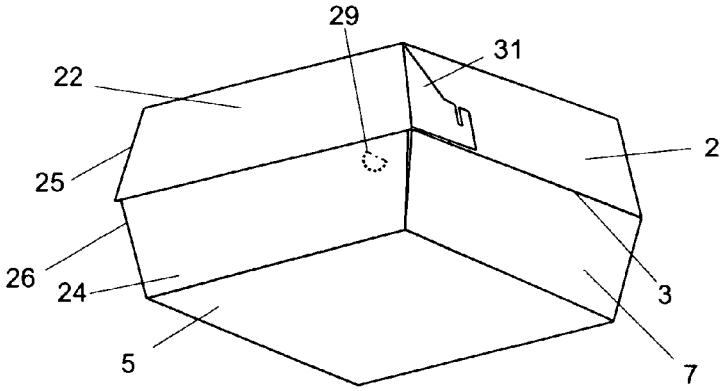
FIG. 6 is a bottom perspective view of the present invention in the closed condition, showing the securing device of an alternative embodiment in a collapsed or folded condition.

In FIG. 6, securing tab 31 is shown folded against inner wall 2 of shell 25. A hook-shaped design for securing device 31 is shown. Receiver aperture 29 is disposed in side wall 24 of shell 26.

Figure 7:
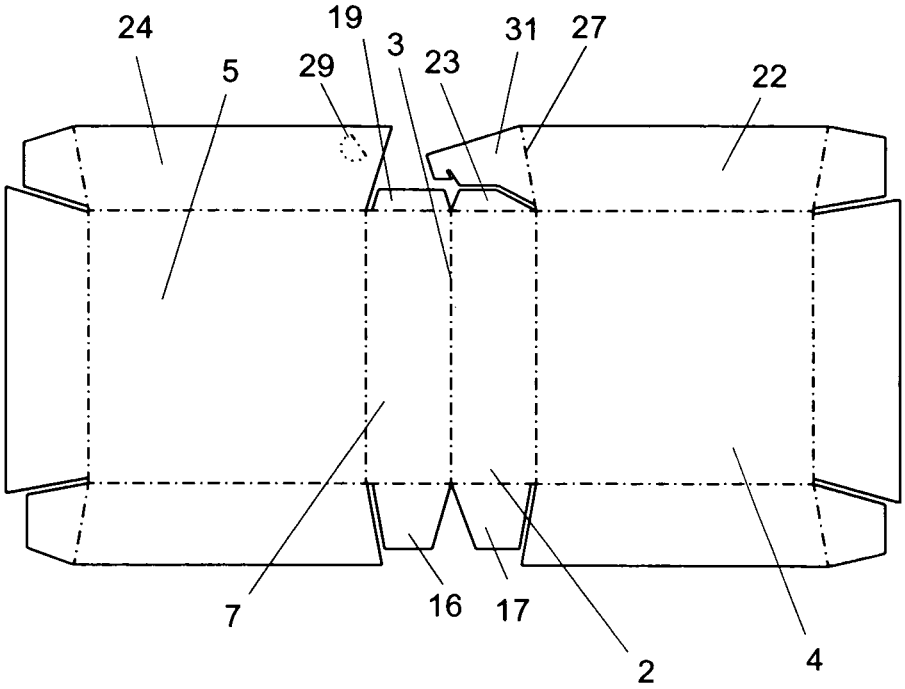
FIG. 7 is a plan view of the unfolded and unassembled blank showing the inside surface for an alternative embodiment.

In FIG. 7, flap 23 and flap 19 are shown with a shorter projection than flap 16 or flap 17 to create a wide and long securing tab 31, however flap 19, flap 16 and flap 17 may be of identical, longer or different projections from flap 23. One of the features of this design is that the securing device 31 is created within the confines of the rectangular blank bounded in part by the edges of side wall 22 and side wall 24.

Figure 8:
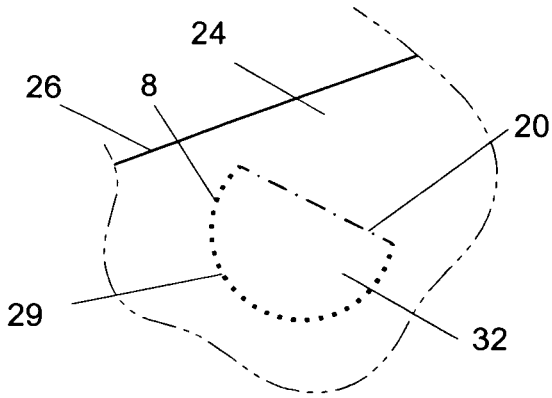
FIG. 8 is a partial detail plan view of the receiving device of the alternate embodiment.

In FIG. 8, receiver aperture 29 is comprised of flap 32 which is defined by hinge 20 and score line 8. The crescent shape shown for score 8 allows the user to push flap 32 through side wall 24 of shell 26; thus creating a place for the hook of securing tab 31 to engage with side wall 24. Other shapes for securing tab 31 and receiver 29 may be used, such as a tee-shaped securing tab 31 and slotted shape receiver 29 or other geometries as are known in the art.

Figure 9:
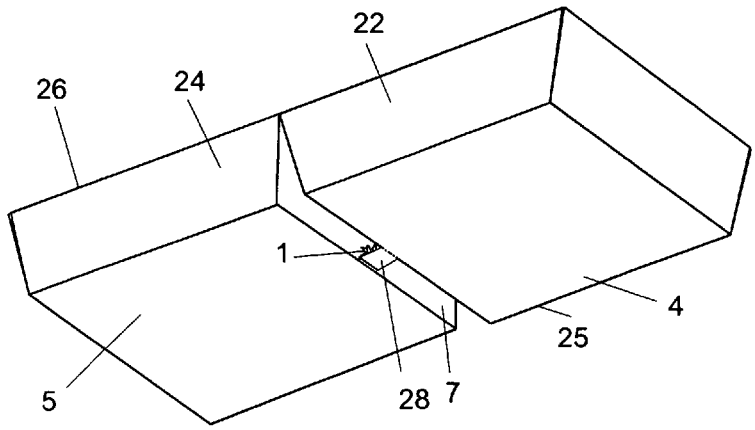
FIG. 9 is a bottom perspective view of the present invention in the open and secured condition illustrating the components of a second alternative embodiment.

In FIG. 9, a tab from the inner wall of one shell is pushed through and engaged into the inner wall of the other shell. Neck 28 is shown spanning the distance between base panel 4 and base panel 5. Although not shown, tab 6 is pushed through end wall 7 and engaged in distorted receiver 1 which includes multiple linear score lines extending from a central point. One of the key features of this design is that the securing point of the securing device is created near the point of maximum possible distance from the container hinge. This creates a maximum moment arm length of the force couple to maximize the moment resisting force, which is developed by the securing device—thus, minimizing tensile and compression forces to resist tearing and failure of the securing device and the container structure surrounding the receiver opening. Another important aspect of this design is that the securing arrangement creates a structural connection close to, or directly between, the planes of the two base panels of the shells to eliminate dependence on flexural strength of the materials. Although the securing device is easily reversed for subsequent transport and storage of the food, the container may be frequently discarded in the open condition.

Figure 10:
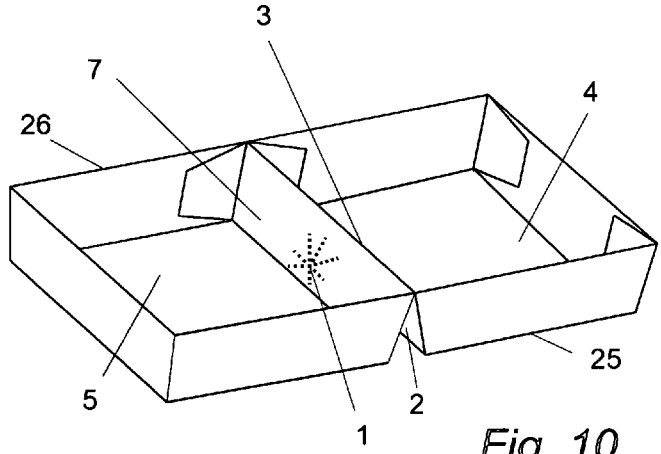
FIG. 10 is a top perspective view of the present invention in an open and unsecured condition illustrating one side of the securing device for the second alternative embodiment.

In FIG. 10, a star-shaped receiver 1 slit is shown in inner wall 7 of the invention. The bottom points of star-shaped receiver 1 are located in close proximity to base panel 5 of shell 26 and is the greatest practical distance from hinge 3 while remaining in end wall 7.

Figure 11:
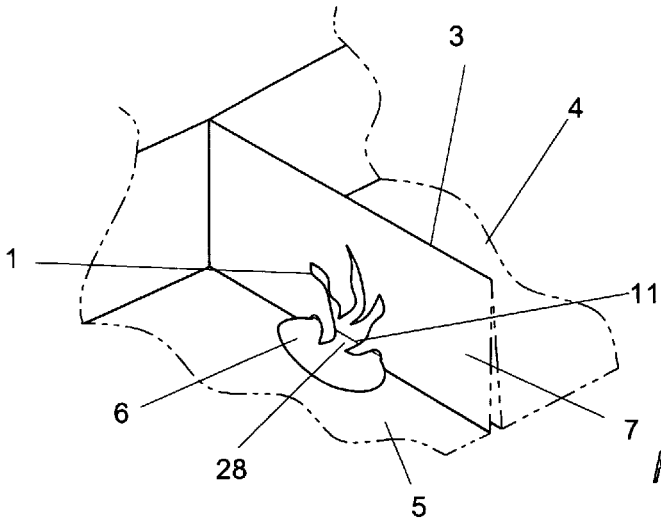
FIG. 11 is a partial section perspective illustrating the securing device in the secured condition for the second alternative embodiment.

FIG. 11 is viewed from the same direction as FIG. 10 with the foreground structure removed for clarity. Tab 6 is shown in the "secured" position, after being pushed through receiver 1. The star-shaped receiver 1 is shown distorted due to the action of the user pushing tab 6 through inner wall 7. Tab 6, which is connected to neck 28, is shown rotated around hinge 11 and pushed through deformed receiver 1. Tab 6 is pushed substantially parallel to and close to base panel 5. As tension is applied to neck 28 through application of substantially vertical forces on the simple supported open container, tab 6 and neck 28 are forced towards base panel 5 by the diagonal lower legs of the star-shaped receiver 1. The side edges of tab 6 engage with the edges of inner wall 7 and the lower legs of receiver 1 provide an opening.

Figure 12:
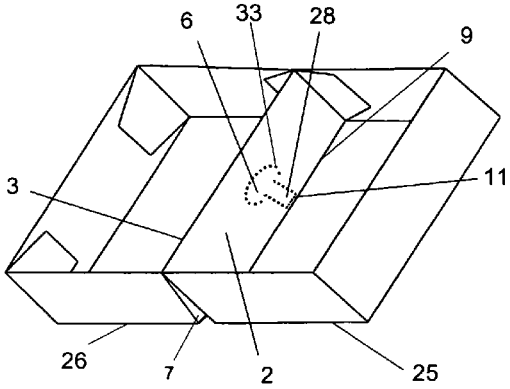
FIG. 12 is a top perspective view of the present invention in an open and unsecured condition illustrating the side opposite from that shown in FIG. 10 of the securing device for the second alternative embodiment.

In FIG. 12, tab 6 is connected to neck 28 and is separated from inner wall 2 by slit 33. Hinge 11 is disposed at the bottom of neck 28 and hingedly connects it with inner wall 2. Slit 33 facilitates the ability to punch tab 6 and neck 28 through inner wall 7 by rotating them along hinge 11.

Figure 13:
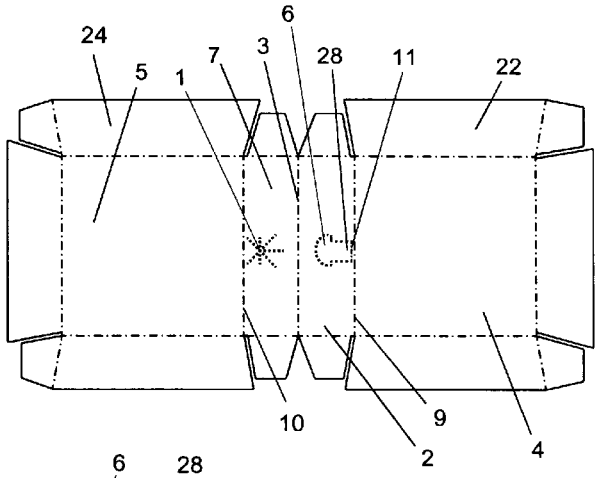
FIG. 13 is a plan view of the unfolded and unassembled blank for the second alternative embodiment.

FIG. 13 is a plan view of the unfolded and unassembled blank for the second alternative embodiment.

Figure 14:
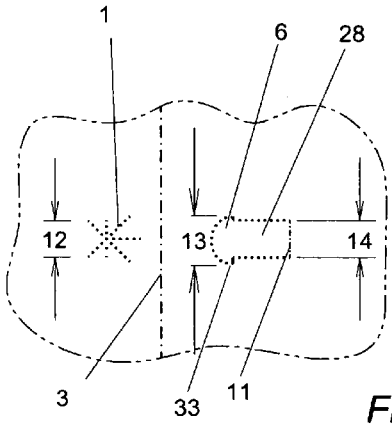
FIG. 14 is a partial plan detail view of the securing device and receiver of the second alternative embodiment.

In FIG. 14, dimension 12 is similar to dimension 14 and both are smaller than dimension 13. This creates shoulders on tab 6 where it transitions to neck 28. It is these shoulders which engage against the inner wall 7 material at the bottom legs of receiver 1 to tension neck 28 when substantially vertical forces are applied to the simple supported open container. Other geometric shapes for design of the securing device to engage base panel 4 and base panel 5 are well known in the art.

Figure 15:
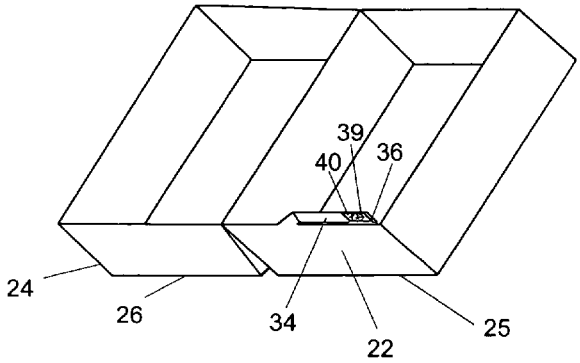
FIG. 15 is a top perspective view of the present invention in an open and unsecured condition illustrating the third alternative embodiment.

In FIG. 15, this embodiment is shown and is useful when fabricating clamshell containers from formed plastic materials such as thermoformed, blowmolded or injection molded plastics, although it can also be used with other materials such as paperboard or polystyrene foam board. Strap 34 is hingedly connected to side wall 22. Strap 34 may also be temporarily connected until use with a small connection material (not shown) between end 36 and side wall 22 or with a longer partial or continuous connection with side wall 22. Adhesive 39 may be covered temporarily by release liner 40.

Figure 16:
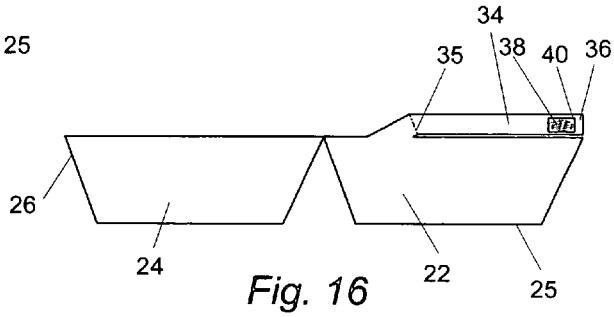
FIG. 16 is a side elevation view of the present invention in an open and unsecured condition illustrating the third alternative embodiment.

In FIG. 16, strap 34 is hingedly attached at angled hinge 35 to side wall 22.

Figure 17:
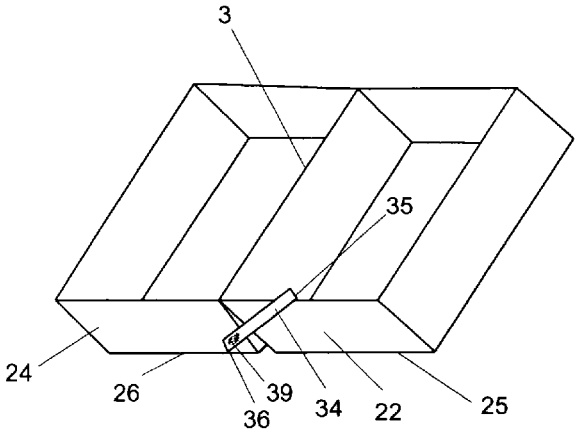
FIG. 17 is a top perspective view of the present invention in an open and secured condition illustrating the third alternative embodiment.
Figure 18:
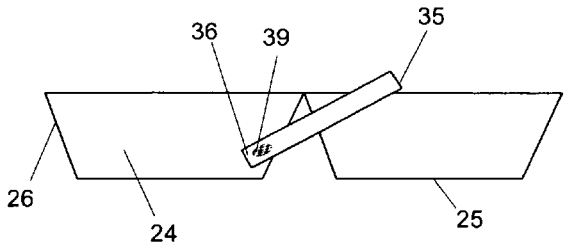
FIG. 18 is a side elevation of the present invention in an open and secured condition illustrating the third alternative embodiment.

In FIG. 17, strap 34 is rotated approximately one hundred and eighty degrees at hinge 35. End 36 is engaged by the user to connect strap 34 to side wall 24. Such attachment device could be adhesive, mating interlocking bulb indentions, magnets, hook and receiver, or other like securing means. Tension forces in strap 34 resist the rotation of shell 26 and shell 25 around hinge 3 when the open container is subjected to gravitational and other substantially vertical forces and from the elastic memory of the fabricated material. Adhesive 39 is shown in hidden lines and secures end 36 to side wall 24.

The invention claimed is:

1. A food container comprising a pair of shells, each shell having a base panel, a side wall secured to one of said base panels, said side wall having a pair of spaced ends, a pair of inner walls joined respectively to said base panels and disposed generally perpendicular to said side wall and said base panels, a securing tab foldably joined to one end of said side wall, one of said inner walls joined to said one base panel and disposed adjacent said securing tab, said securing tab disposed in overlapping face contacting relation with said adjacent one of said inner walls when said food container is in a closed condition, said side wall upstanding from said one base panel, a second side wall secured to the other of said base panels, said base panels being in general alignment and said side walls being in general alignment, said inner walls being disposed in angular near contacting relation, and said securing tab being secured to said second side wall to provide structural resistance to the shells moving toward and away from each other when said container is in an open condition.

2. A food container according to claim 1 wherein a hook is formed on the end of said securing tab remote from said side wall.

3. A food container according to claim 2 wherein, a receiver aperture is formed in said second side wall, and said hook is interlocked with said receiver aperture.

4. A food container according to claim 3 wherein said receiver aperture comprises a flap and said flap is defined by a score line and a hinge line.

5. A food container according to claim 1 wherein said securing tab is joined to said second side wall by adhesive means.

* * * * *